US011230137B2

(12) United States Patent
Bez et al.

(10) Patent No.: US 11,230,137 B2
(45) Date of Patent: Jan. 25, 2022

(54) MULTI-FUNCTION WRITING INSTRUMENT COMPRISING A LEADHOLDER SYSTEM

(71) Applicant: SOCIETE BIC, Clichy (FR)

(72) Inventors: Arnaud Bez, Garches (FR); Myriam Oger, Paris (FR); Etienne Michenaud, Montrouge (FR); Franck Rolion, Asnieres sur Oise (FR)

(73) Assignee: Societe BIC, Clichy (FR)

( * ) Notice: Subject to any disclaimer, the term of this patent is extended or adjusted under 35 U.S.C. 154(b) by 44 days.

(21) Appl. No.: 16/956,214

(22) PCT Filed: Dec. 14, 2018

(86) PCT No.: PCT/FR2018/053293
§ 371 (c)(1),
(2) Date: Jun. 19, 2020

(87) PCT Pub. No.: WO2019/122630
PCT Pub. Date: Jun. 27, 2019

(65) Prior Publication Data

US 2020/0398607 A1 Dec. 24, 2020

(30) Foreign Application Priority Data

Dec. 20, 2017 (FR) ..... 1762648

(51) Int. Cl.
*B43K 27/02* (2006.01)
*B43K 21/00* (2006.01)
(Continued)

(52) U.S. Cl.
CPC ..... *B43K 27/02* (2013.01); *B43K 21/003* (2013.01); *B43K 21/006* (2013.01); *B43K 24/04* (2013.01); *B43K 24/082* (2013.01); *B43K 25/02* (2013.01)

(58) Field of Classification Search
CPC .... B43K 21/003; B43K 21/006; B43K 24/04; B43K 24/08; B43K 24/082; B43K 25/02; B43K 27/02
See application file for complete search history.

(56) References Cited

U.S. PATENT DOCUMENTS 3,062,191 A * 11/1962 Haltern, Jr. ..... B43K 24/08 401/110
3,084,670 A * 4/1963 Dottlinger ..... B43K 24/086 401/111
(Continued)

FOREIGN PATENT DOCUMENTS

EP 0378724 A1 7/1990

OTHER PUBLICATIONS

International Search Report issued in International Application PCT/FR2018/053293, dated Mar. 25, 2019, with English translation (5 pages).

*Primary Examiner* — J C Jacyna
(74) *Attorney, Agent, or Firm* — Bookoff McAndrews, PLLC

(57) ABSTRACT

A multi-function writing instrument comprises a body extending in an axial direction and a radial direction, and having at least two writing elements arranged inside the body, each writing element comprising a writing head and a button, at least one button extending in the radial direction through a window and allowing the writing element to be moved between a retracted position in which the writing head is retracted into the body and a writing position in which the writing head projects from the body, and one of the writing elements being a leadholder system comprising a leadholder mechanism and a lead container, the button of the leadholder system comprising a lead-insertion channel extending in the axial direction.

11 Claims, 5 Drawing Sheets

(51) Int. Cl.

| | |
|---|---|
| ***B43K 24/04*** | (2006.01) |
| ***B43K 24/08*** | (2006.01) |
| *B43K 25/02* | (2006.01) |

(56) References Cited

U.S. PATENT DOCUMENTS

| | | | | | |
|---|---|---|---|---|---|
| 3,232,278 | A * | 2/1966 | Johmann | B43K 24/02 401/103 |
| 4,148,591 | A * | 4/1979 | Tomura | B43K 27/02 401/17 |
| 5,749,663 | A | 5/1998 | Takahashi | |
| 10,974,540 | B1 * | 4/2021 | Yu | B43K 7/12 |
| 2006/0171762 | A1 * | 8/2006 | Mayne | B43K 24/04 401/115 |
| 2018/0333980 | A1 * | 11/2018 | Namiki | B43K 29/02 |
| 2019/0322121 | A1 * | 10/2019 | Mazingue | B43L 19/0075 |

* cited by examiner

MULTI-FUNCTION WRITING INSTRUMENT COMPRISING A LEADHOLDER SYSTEM

CROSS REFERENCE TO RELATED APPLICATION(S)

This application is a National Stage Application of International Application No. PCT/FR2018/053293, filed on Dec. 14, 2018, now published as WO2019/122630 and which claims priority to French Application No. FR1762648, filed on Dec. 20, 2017.

TECHNOLOGICAL FIELD

The present disclosure concerns a multi-function writing instrument comprising a lead-holder system. It will be recalled that a multi-function writing instrument is a writing instruments comprising a plurality of writing elements, and each writing element may be used selectively.

BACKGROUND

A multi-function writing instrument comprising a lead-holder system is known. The lead-holder system comprises, in a known manner, a lead-holder mechanism and a lead container.

However, when the lead container is empty, it is usually difficult for a user to fill the container with new leads. This is because the user must remove the lead-holder system from the multi-function writing instrument, which may prove complex and difficult to perform, or must remove the lead-holder mechanism which may also prove difficult and could lead to the loss of elements of the lead-holder mechanism, such as the spring of the lead-holder mechanism.

PRESENTATION

The present disclosure aims to overcome these drawbacks, at least in part.

Accordingly, the present disclosure concerns a multi-function writing instrument comprising a body extending in an axial direction and a radial direction, and having at least two writing elements arranged inside the body, each writing element comprising a writing head and a button, at least one button extending in the radial direction through a window and allowing the writing element to move between a retracted position in which the writing head is retracted in the body and a writing position in which the writing head projects from the body, one of the writing elements being a lead-holder system comprising a lead-holder mechanism and a lead container, the button of the lead-holder system comprising a lead-insertion through-channel extending in the axial direction.

The lead-insertion through-channel allows new leads to be inserted in the lead container through a button of the lead-holder system. The user may thus insert new leads in the lead container without removing the lead-holder system from the multi-function writing instrument.

"The lead-insertion through-channel extends in the axial direction" means that the through-channel may not be strictly parallel to the axial direction and/or may not be rectilinear in the axial direction.

Hereinafter, and unless indicated otherwise, "writing instrument" means "multi-function writing instrument."

Of course, the multi-function writing instrument may have two or more than two writing elements. Hereinafter, and unless indicated otherwise, "writing elements" means "the at least two writing elements."

Within the meaning of the present disclosure, a writing element is formed by any element comprising a writing head and a button. Hereinafter, and unless indicated otherwise, the writing head of any writing element is considered to have a writing tip, and the writing tip may be fixed (for example, a ballpoint) or movable (for example a lead holder lead) relative to the writing head. The writing tip may, for example, be a felt tip, a ball or other element, a graphite lead, a lead holder lead, a crayon, any means that allows writing on a substrate or any end piece (active or passive) configured to cooperate with a screen, for example a capacitive or resistive screen. For example, if the writing element comprises a ballpoint, it also comprises an ink reservoir.

For example, if the writing element comprises a fixed writing tip, such as a ball for example fitted to a writing head, the writing head being fitted to an ink reservoir, in the retracted position the writing tip is retracted into the body, whereas in the writing position the writing tip extends outside the body. According to another example, if the writing tip of the writing element is movable, such as, for example, a lead carried by a head of a lead-holder mechanism in the retracted position, the lead may be retracted into the lead holder, and the head of the lead holder may also be retracted into the body or may extend outside the body or the lead may extend outside the head of the lead holder whilst the head is retracted into the body, the lead not projecting from the body. Of course, in the writing position this type of movable writing tip extends outside the body, and the head of the writing element may be outside or inside the body. In other words, for writing elements with a movable writing tip, an actuation device may serve only to cause the writing tip to come out of and/or return into the head of the writing element (for example to cause the lead of a lead-holder system to advance, and to allow the return thereof into the lead-holder system when the jaws of the lead-holder mechanism are released and pressure is applied to the lead).

It will of course be understood that the body may be formed in a single part or may comprise a plurality of separate parts. Within the present disclosure, the body comprises all the parts other than the writing element(s) and the locking body. The body is of course hollow and configured to receive the writing element. The body therefore has an inside and an outside. The side window is a through-window arranged in a wall of the body and opening out radially. The body is provided with at least one window for each writing element. Thus, the button of each writing element is received in a different window. In other words, there are at least as many windows as writing elements. However, it is possible that a writing element may be actuated by a rear button or a rotation of a front portion of the body relative to a rear portion of the body. There could therefore be a different number of windows and writing elements.

It will also be understood that any known type of retraction mechanism also allows the writing element to move between the retracted position and the writing position by means of the button, and the writing element to be maintained in each of these positions. Of course, there are as many retraction mechanisms as writing elements, each mechanism being specific to a writing element. In other words, each writing element is provided with such a retraction mechanism.

The button is guided in the window for moving the writing element from the writing position to the retracted position and vice versa. For example, the window is substantially rectangular in shape, the long sides of the rectangle extending in the axial direction. In such an example, the button is guided axially by the long sides of the window. The short sides may limit the axial travel of the button, but not necessarily.

In some embodiments, the multi-function writing instrument comprises a device for retaining leads in the lead container which may take up a position for retaining leads in the lead container and a position for inserting leads in the lead container through the lead-insertion through-channel.

In some embodiments, the retention device is configured to pass from the lead retention position to the lead insertion position and from the lead insertion position to the lead retention position by gravity.

"Gravity" and "direction of gravity" means of course the direction of Newtonian gravitational acceleration created by the Earth or, more generally, by the body or heavenly body on which the multi-function writing instrument is used.

Thus, if the multi-function writing instrument is used for writing, in other words the writing head is below the button in terms of the direction of gravity, the retention device is in the lead insertion position, whereas if the multi-function writing instrument is in the opposite position, in other words if the button is below the writing head in terms of the direction of gravity, the lead retention device is in the retention position and prevents the leads contained in the lead container from coming out of the lead container under the effect of gravity.

In some embodiments, the retention device comprises a chamber and a ball or equivalent element, the ball being received in the chamber.

"Ball or equivalent element" means any solid element of any shape which is movable in the chamber and suitable for being moved in the chamber under the effect of gravity relative to the walls delimiting the cavity of the chamber. Hereinafter, and unless indicated otherwise, "ball" means "ball or equivalent element." Clearly, the chamber may be of any shape, and may be simple or complex.

Thus, with reference to the direction of gravity, owing to the ball which moves inside the chamber, when the writing head is below the button, the retention device allows leads to be inserted in the lead container, whereas when the writing head is above the button, the retention device prevents the leads from coming out of the lead container. Hereinafter, and unless indicated otherwise, the relative position "above" or "below" the different portions is considered relative to the direction of gravity.

In some embodiments, the chamber is at least in part arranged in the lead-insertion through-channel.

In some embodiments, the minimum distance between two walls delimiting a cavity of the chamber is between 102% and 125% of the diameter of the ball (or of the largest dimension of the ball if the "ball or equivalent element" is not spherical).

It will be understood that the walls delimit a cavity configured to receive the ball. For example, the walls belong respectively to two different elements and delimit, being arranged facing one another, a cavity for receiving the ball, the cavity forming at least a portion of the enclosed space of the chamber. Such a configuration helps ensure good circulation of the ball inside the chamber while obtaining a small space requirement for the retention device.

In some embodiments, the lead-insertion through-channel comprises a groove.

In some embodiments, the lead-insertion through-channel is a through-hole having a closed contour.

In some embodiments, the multi-function writing instrument comprises an eraser and an eraser protection cap, the cap forming the lead retention device.

In some embodiments, the through-hole having a closed contour is extended by a notch in at least one element of the multi-function writing instrument arranged between the through-hole and the cap.

In some embodiments, the lead-insertion through-channel has a minimum diameter greater than or equal to 0.575 mm (millimeter), specifically greater than or equal to 0.6 mm, still more specifically greater than or equal to 0.725 mm and less than or equal to 1.5 mm, specifically less than or equal to 1.2 mm.

"Minimum diameter" means the smallest dimension of the lead-insertion through-channel measured in a plane perpendicular to the axial direction. It will be understood that the minimum diameter of the lead-insertion through-channel depends on the dimensions of the leads, in other words the diameter thereof. Thus, for leads with a diameter of 0.7 mm, the minimum diameter of the lead-insertion through-channel will be greater than or equal to 0.725 mm. The minimum diameter of the lead-insertion through-channel also depends on the dimensions of the button.

BRIEF DESCRIPTION OF THE DRAWINGS

Other characteristics and advantages of the object of the present disclosure will appear from the following description of embodiments, given as non-limiting examples, with reference to the accompanying drawings, in which.

In all the figures, common elements are indicated with identical reference numerals.

DETAILED DESCRIPTION

Figure 1:
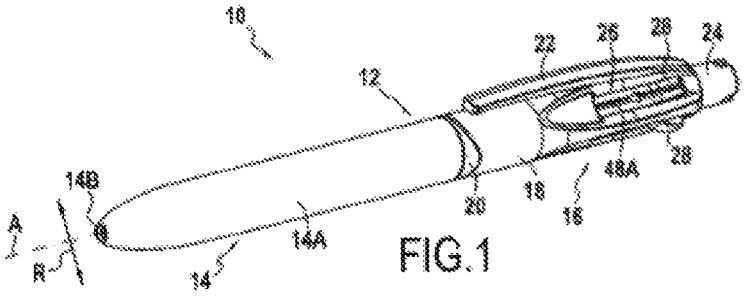
FIG. 1 is a perspective view of a multi-function writing instrument comprising a lead-holder system.
Figure 3:
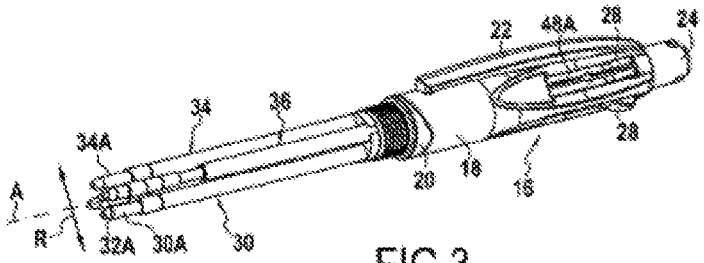
FIG. 3 is a perspective view of the multi-function writing instrument of FIG. 1, with no front barrel.
Figure 4:
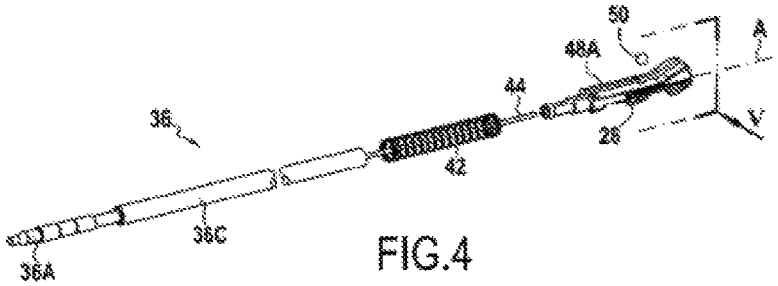
FIG. 4 is an exploded view of the lead-holder system.
Figure 2:
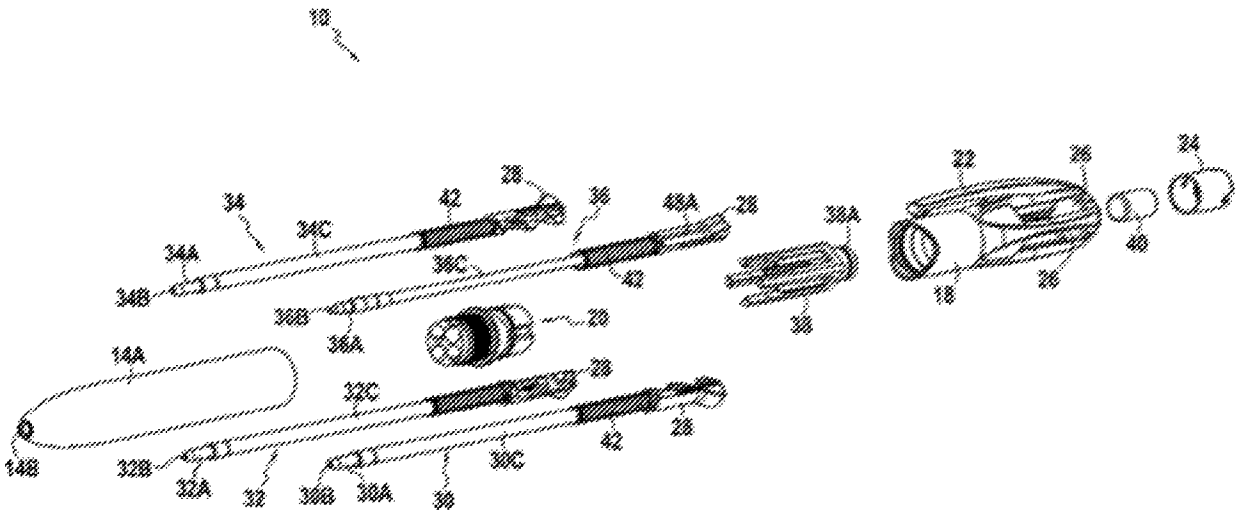
FIG. 2 is an exploded view of the multi-function writing instrument of FIG. 1 according to a first embodiment.

FIG. 1 shows a multi-function writing instrument 10 comprising a body 12 extending in an axial direction A. The body 12 comprises a front portion 14 and a rear portion 16. In the embodiment in FIG. 1, the front portion 14 is composed of a front barrel 14A and the rear portion 16 comprises a rear barrel 18 and an element 20 for connecting the rear barrel 18 to the front barrel 14A. The rear barrel 18 comprises a clip 22 and a cap 24. As shown in FIGS. 1 and 2, the rear barrel 18 also comprises side windows 26 in which are received buttons 28 for four writing elements 30, 32, 34, 36 arranged in the body 12.

As shown in FIG. 2, each writing element 30, 32, 34 comprises a writing head 30A, 32A, 34A, comprising a fixed writing tip 30B, 32B, 34B, such as a ball, and an ink reservoir 30C, 32C, 34C. Each writing element 30, 32, 34 also comprises a button 28 fitted to the ink reservoir. The writing element is a lead-holder system 36 which comprises a lead-holder mechanism 36A and a lead container 36C. The lead-holder mechanism 36A forms the writing head of the lead-holder system 36.

The front barrel 14A comprises an opening 14B through which a writing head may project.

The multi-function writing instrument 10 also comprises a locking element 38 and an eraser 40. The eraser 40 is protected by the cap 24. The cap 24 is therefore a protection cap 24 for the eraser 40.

The locking element 38 is inserted in the rear barrel 18 in such a way that the eraser reception element 38A of the locking element 38 projects from the rear barrel 18. The locking element 38 comprises four fingers 38B extending in the axial direction A which, in cooperation with the windows 26, guide the buttons 28 of the writing elements 30, 32, 34, 36 when each writing element 30, 32, 34, 36 passes from the retracted position to the writing position and vice versa. To pass from the writing position to the retracted position, each writing element 30, 32, 34, 36 also comprises a return spring 42. The return spring 42 rests on the button 28 and on the connection element 20.

When the multi-function writing instrument 10 is assembled, the user may select a writing element by depressing the corresponding button 28. The movement of a writing element from the retracted position to the writing position causes any other writing element to pass to the retracted position, in particular by means of the return spring 42.

When the lead-holder system 36 is in the writing position, in other words when the lead-holder mechanism 36A projects from the front barrel 14A through the opening 14B, the lead-holder mechanism 36A may be actuated by pushing on the cap 24 of the multi-function writing instrument 10. Because of the cap 24, when the lead-holder mechanism 36A is actuated, there is no risk of a user dirtying the eraser 40. The cap 24 and the locking element 38 form part of the actuation device of the lead-holder mechanism.

As shown in FIGS. 2 to 12, the button 28 of the lead-holder system 36 comprises a lead-insertion through-channel 46.

The lead-insertion through-channel 46 allows a user to insert new leads into the lead container 36C.

The lead-insertion through-channel 46 may have a minimum diameter greater than or equal to 0.575 mm, specifically greater than or equal to 0.6 mm, still more specifically greater than or equal to 0.725 mm and less than or equal to 1.5 mm, specifically less than or equal to 1.2 mm.

Figure 5:
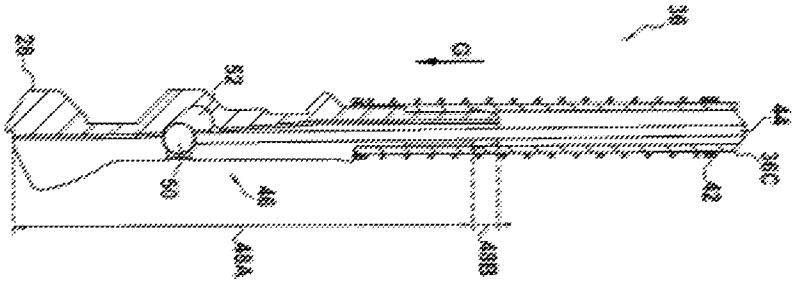
FIGS. 5 and 6 are views in cross section along the cutting plane V-V of FIG. 4 in the retention position and in the insertion position, respectively.
Figure 6:
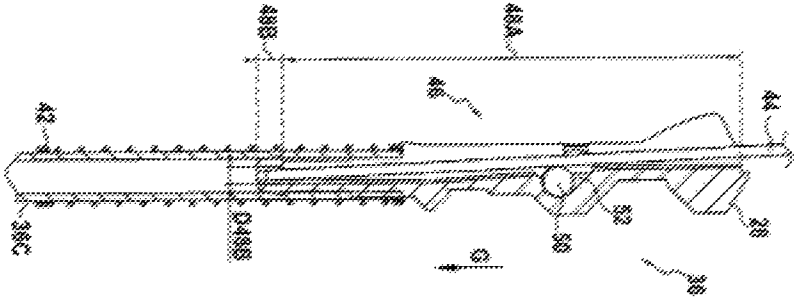
Figure 7:
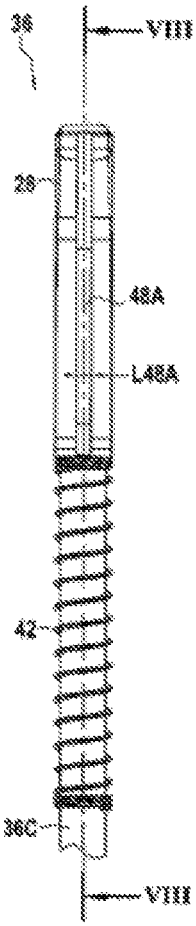
FIGS. 7 and 8 are views of the lead-holder system according to a second embodiment.
Figure 8:
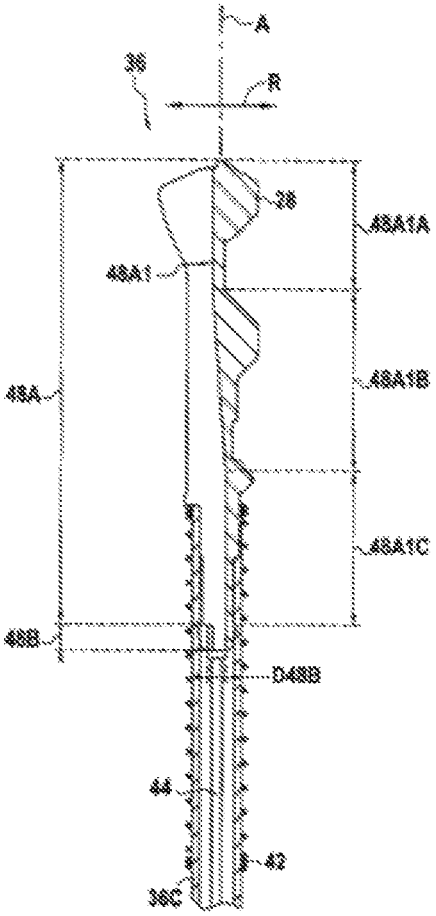
Figure 9:
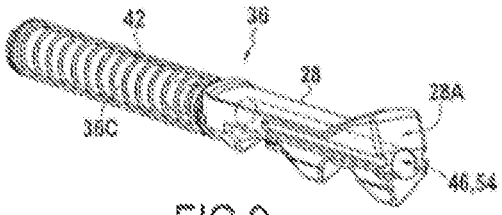
FIGS. 9 to 14 are views according to a third embodiment.
Figure 10:
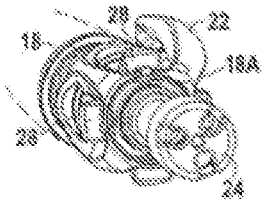

In the embodiment in FIGS. 1 to 8, the lead-insertion through-channel 46 comprises a groove 48A comprising an open side portion opening into a portion having a closed contour 48B, as shown in FIGS. 5, 6 and 8.

As shown in FIGS. 7 and 8, the width L48A of the groove 46 may be less than or equal to 1 mm. This groove width L48A allows leads with a diameter of 0.5 mm or 0.7 mm to be inserted in the lead container 36C of the lead-holder system 36.

Moreover, the lead-insertion through-channel 46 has a minimum diameter D48B which is for example equal to 0.8 mm. This minimum diameter D48B of the lead-insertion through-channel 46 allows leads with a diameter of 0.5 mm or 0.7 mm to be inserted in the lead container 36C of the lead-holder system 36.

As shown in FIG. 7, the groove 48A and therefore the lead-insertion through-channel 46 extends in the axial direction A. Moreover, as shown in FIG. 8, the bottom of the groove 48A has a surface 48A1 comprising three portions, a first portion 48A1A of which the surface extends substantially in the axial direction A, a second portion 48A1B of which the surface slopes relative to the axial direction A by 4.2° and a third portion 48A1C of which the surface extends substantially in the axial direction A. It will be understood that the groove 48A extends in the axial direction A although the bottom of the groove 48A has a surface 48A1 comprising three portions.

In the embodiment in FIGS. 7 and 8, when the user wishes to add leads to the lead container 36C, the user inserts a lead 44 in the groove 48A of the button 28. The lead 44 abuts the bottom of the groove 48A and is guided in the groove 48A up to the portion having a closed contour 48B, in particular through the second and third portions 48A1B, 48A1C of the surface 48A1 of the bottom of the groove 48A. The lead 44 then enters the lead container 36C.

Hereinafter, elements common to the different embodiments are identified by the same reference numerals.

In the embodiment in FIGS. 1 to 6, the multi-function writing instrument 10 comprises a lead retention device which may take up a lead retention position in the lead container 36C and a lead insertion position in the lead container 36C through the lead-insertion through-channel 46.

In the embodiments in FIGS. 1 to 6, the retention device comprises a ball 50 or equivalent element received in a chamber 52. In the embodiment in FIGS. 1 to 6, the chamber 52 is arranged at least in part in the groove 48A, in other words at least in part in the lead-insertion through-channel 46.

As shown in FIG. 5, the lead-holder system 36 is shown in the lead retention position. The ball 50 is arranged in the chamber in such a way that the lead 44 cannot come out of the lead container 36C.

As shown in FIG. 6, the lead-holder system 36 is shown in the position for inserting leads in the lead container 36C. The ball 50 is arranged in the chamber in such a way that the lead 44 can be guided by the groove 48A towards the lead container 36C.

It will be understood that the ball 50 takes up the lead insertion or lead retention position in the chamber 52 under the effect of the force of gravity shown by the arrow G. Thus, the device for retaining leads in the lead container 36C passes from one position to the other by gravity. The ball 50 may for example have a diameter of 2 mm. The ball may for example be made of metal, for example tungsten carbide (WC), glass, a loaded plastics material and/or ceramic, such that the ball 50 may take one or other position under the effect of gravity and its own weight.

FIGS. 9 to 14 show a third embodiment in which the lead-insertion through-channel 46 is a through-hole 54 having a closed contour.

Figure 11:
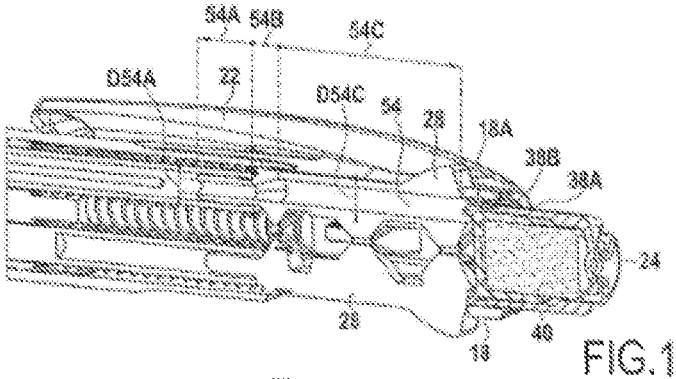
Figure 12:
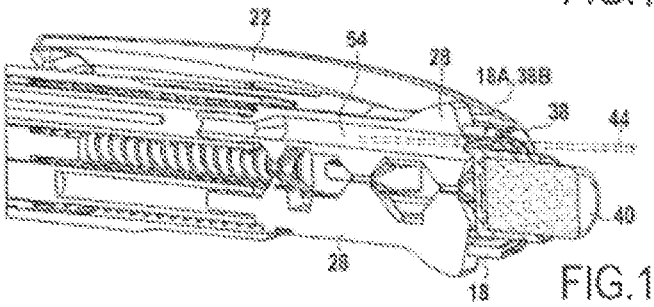
Figure 13:
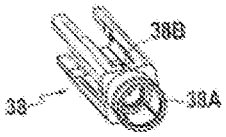
Figure 14:
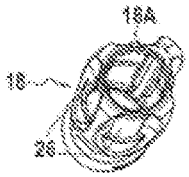

As shown in FIGS. 11 and 12, the through-hole 54 comprises three portions having different cross sections, a first portion 54A substantially cylindrical in shape and extending in the axial direction A, a second portion 54B forming the transition between the first portion 54A and a third portion 54C. The third portion 54C opens out at the apex 28A of the button 28.

The through-hole 54, in particular the first portion 54A of the through-hole 54, has a minimum diameter D54A. For example, the minimum diameter D54A may be equal to 1.1 mm. This minimum diameter D54A allows leads with a diameter of 0.5 mm or 0.7 mm to be inserted in the lead container 36C of the lead-holder system 36.

Moreover, the third portion 54C has a diameter D54C which is greater than the minimum diameter D54A of the through-hole 54. Because this diameter D54C is greater than the minimum diameter D54A, the insertion of leads 44 in the lead container 36C is facilitated.

In the embodiment in FIGS. 10 to 14, the locking element 38 and the rear barrel 18 each comprise a notch 38B, 18A arranged in the extension of the through-hole 54. In the embodiment in FIGS. 10 to 14, the rear barrel 18 and the locking element 38 are arranged between the through-hole 54 and the cap 24 of the multi-function writing instrument 10, although owing to the presence of the notches 18A, 38B, when the cap 24 is removed from the multi-function writing instrument 10, the through-hole 54 is accessible and allows leads 44 to be inserted in the lead container 36C through the through-hole 54, as shown in FIG. 12. The cap 24 therefore forms the lead retention device. It will therefore be understood that in FIG. 11, the cap 24 is in the position for retaining leads in the lead container 36C and that in FIG. 12, as the cap 24 has been removed, the cap 24 is in the position for inserting leads in the lead container 36C.

It will be understood that depending on the configuration of the multi-function writing instrument 10, parts of the multi-function writing instrument 10 may not be present in the extension of the through-hole 54. In addition, in these embodiments, the notches 18A, 38B of the rear barrel 18 and/or of the locking element 38 might not be necessary in order to have access to the through-hole 54 for inserting leads 44 in the lead container 36C.

Although the present disclosure has been made with reference to a specific embodiment, it is clear that various modifications and changes may be made to these examples without departing from the general scope as defined by the claims. Moreover, individual characteristics of the different embodiments referred to may be combined in additional embodiments. Consequently, the description and the drawings should be considered in an illustrative rather than a restrictive sense.

For example, the multi-function writing instrument 10 is presented with four writing elements. The multi-function writing instrument 10 could comprise a different number thereof, for example two or five. Moreover, the writing elements 30, 32, 34 may not comprise a writing tip comprising a ball. Each writing element could be of a different type from the other writing elements. It could also be envisaged that the multi-function writing instrument 10 might comprise a plurality of lead-holder systems 36, each lead-holder system 36 comprising in the respective lead container thereof leads of different sizes and/or colors. As mentioned above, the writing element may also be any means that allows writing on a substrate or any end piece (active or passive) configured to cooperate with a screen, for example a capacitive or resistive screen.

In the embodiments presented, each writing element comprises a side button, but it is possible that a writing element is actuated by a rear button.

The through-hole could also comprise a similar retention device comprising a ball or equivalent element received in a chamber arranged at least in part in the through-hole.

The invention claimed is:

1. A multi-function writing instrument comprising a body extending in an axial direction and a radial direction, and having at least two writing elements arranged inside the body, each writing element comprising a writing head and a button, at least one button extending in the radial direction through a window and allowing the writing element to be moved between a retracted position in which the writing head is retracted into the body and a writing position in which the writing head projects from the body, one of the writing elements being a lead-holder system comprising a lead-holder mechanism and a lead container, the button of the lead-holder system comprising a lead-insertion through-channel extending in the axial direction, the writing instrument further comprising a device for retaining leads in the lead container which is configured to adopt a position for retaining leads in the lead container and a position for inserting leads in the lead container through the lead-insertion through-channel, and wherein the retention device is configured to pass from the lead retention position to the lead insertion position and from the lead insertion position to the lead retention position by gravity.

2. A multi-function writing instrument according to claim 1, wherein the retention device comprises a chamber and a ball, the ball being received in the chamber.

3. A multi-function writing instrument according to claim 2, wherein the chamber is at least in part arranged in the lead-insertion through-channel.

4. A multi-function writing instrument according to claim 1, wherein the lead-insertion through-channel comprises a groove.

5. A multi-function writing instrument according to claim 1, wherein the lead-insertion through-channel is a through-hole having a closed contour.

6. A multi-function writing instrument according to claim 5, comprising an eraser and an eraser protection cap, the cap forming the lead retention device.

7. A multi-function writing instrument according to claim 6, wherein the through-hole has a closed contour that is extended by a notch in at least one element of the multi-function writing instrument arranged between the through-hole and the cap.

8. A multi-function writing instrument according to claim 1, wherein the lead-insertion through-channel has a minimum diameter greater than or equal to 0.575 mm and less than or equal to 1.5 mm.

9. A multi-function writing instrument comprising a body extending in an axial direction and a radial direction, the writing instrument having two or more writing elements arranged inside the body, wherein the writing elements comprise a writing head and a button, one or more buttons extending in the radial direction and being guided in a window for moving the writing element from a retracted position in which the writing head is retracted inside the body to a writing position in which the writing head is projected from the body, wherein one of the writing elements is a lead-holder system comprising a lead-holder mechanism and a lead container, the button of the lead-holder system comprising a lead-insertion through-channel extending in the axial direction, the writing instrument further comprising a retention device configured to retain leads in the lead container which is configured to adopt a lead retention position for retaining leads in the lead container and a lead insertion position for inserting leads in the lead container through the lead-insertion through-channel, and wherein the retention device is configured to pass from the lead retention position to the lead insertion position and from the lead insertion position to the lead retention position by gravity.

10. A multi-function writing instrument according to claim 9, wherein the retention device comprises a chamber and a ball, the ball being received in the chamber.

11. A multi-function writing instrument according to claim 10, wherein the chamber is at least in part arranged in the lead-insertion through-channel.

* * * * *